United States Patent [19]

Uher et al.

[11] 4,235,632

[45] Nov. 25, 1980

[54] PARTICULATE SLAGGING COMPOSITION FOR THE EXTENDED OPTIMUM CONTINUOUS CASTING OF STEEL

[75] Inventors: Joseph F. Uher, Timonium; Charles M. Loane, Jr., Bel Air, both of Md.

[73] Assignee: Mobay Chemical Corporation, Pittsburgh, Pa.

[21] Appl. No.: 26,925

[22] Filed: Apr. 4, 1979

Related U.S. Application Data

[63] Continuation-in-part of Ser. No. 14,649, Feb. 23, 1979.

[51] Int. Cl.[2] ..... C22B 9/10

[52] U.S. Cl. ..... 75/257; 75/53; 164/55; 164/56

[58] Field of Search ..... 75/53, 257; 148/26; 164/55, 56

[56] References Cited

U.S. PATENT DOCUMENTS

| | | | |
|---|---|---|---|
| 3,052,936 | 9/1962 | Hamilton | 75/53 |
| 3,331,680 | 7/1967 | Leupold | 75/53 |
| 3,959,031 | 5/1976 | More | 148/26 |
| 4,066,478 | 4/1979 | DeHaeck | 148/26 |

*Primary Examiner*—P. D. Rosenberg

*Attorney, Agent, or Firm*—Gene Harsh; Joseph C. Gil

[57] ABSTRACT

A particulate slagging composition for the extended optimum continuous casting of a steel which tends to evolve alumina into the molten protective layer of said composition maintained on the top of a pool of molten steel. Such particulate slagging composition is characterized by a R′ ratio (the sum of the theoretical net oxide analysis values of $CaO+MgO+BaO+SrO+MnO+FeO+F+B_2O_3$ to the theoretical net oxide analysis value of $SiO_2$) preselected for obtaining Opertional ADK values not substantially in excess of about 750 seconds after substantial absorption of alumina from the steel.

14 Claims, No Drawings

PARTICULATE SLAGGING COMPOSITION FOR THE EXTENDED OPTIMUM CONTINUOUS CASTING OF STEEL

This application is a continuation-in-part of copending application Ser. No. 014,649, filed Feb. 23, 1979. This invention relates to a particulate slagging composition useful for the continuous casting of steels and to a process for using said particulate slagging composition.

BACKGROUND OF THE INVENTION

A variety of particulate slagging compositions, also referred to as "mold powders", "slags", or "fluxes", have been proposed for the continuous casting of steels, a fairly recent development in steel mill practice. Such materials protect the molten metal from air oxidation while usually fluxing or solubilizing and thereby removing some oxide impurities present in the steel melt. Additionally, lubrication of the mold often can be enhanced by the use of such materials. Typically, the material is fed or poured on the top surface of the molten metal. Occasionally this top is referred to as the meniscus.

In the trade the terms "flux", "slag", or "mold powders" often have been used interchangeably for fritted or preponderantly fritted material to be used in continuous casting service. For convenience, a particulate slagging composition will be defined as encompassing all types of materials used to protect and lubricate the steel during continuous casting. A "vitrifaction" will be defined as a totally vitrified (fritted) material or mixture of fritted material for the instant purpose. A "flux" will be a vitrifaction to which there is added non-vitrified material in small proportion, that is, less than about 30% of the total flux. Separate from both flux and vitrifaction, are "mold powders" which shall be defined as essentially raw materials which have not been vitrified to any appreciable extent. Typically, the instant particulate slagging compositions without carbon are made by comminuting the components and/or vitrified components, then blending if necessary. The exemplified vitreous fluxes shown in U.S. Pat. No. 3,926,246 and U.S. Pat. No. 4,092,159 feature a portion of the fluorine-providing material mixed unfritted with the balance of the glass formers which are fritted. This is done to minimize smelter attack during making of the fritted portion of the particulate slagging composition. Ordinarily from 1–10% and preferably 1–5% by weight of powdered graphite is added to make the final continuous casting particulate slagging composition. Such graphite is for the purpose of minimizing heat loss from the surface of the molten metal.

Steels now continuously cast in production operations include various aluminum-killed steel, silicon-killed steel, and austenitic stainless steel. The problems involved in formulating a particulate slagging composition for use in continuous casting steel have been addressed in previous industry literature. Specifically, U.S. Pat. Nos. 3,649,249, 3,704,744, and 3,899,324 show some of the attempts by others to maximize the performance of the particulate slagging compositions used.

Recongnition has also been given in the industry literature to a problem concerning the absorption of alumina into the melted slagging composition during continuous casting. The alumina comes from the steel being cast. The problem is the most severe when aluminum-killed steel is being cast. Of course, aluminum-killed steel is the predominant type of steel produced by continuous casters. The absorption of alumina into the particulate slagging composition leads to an eventual deterioration in performance characteristics. As the continuous casting run of steel is extended in time, more and more alumina is absorbed into the molten particulate slagging composition. After a certain optimum casting run length, the molten particulate slagging composition's performance so deteriorates that the caster's steel output must be slowed down because the molten composition cannot transfer heat away from the forming solid steel shell fast enough to thicken the shell sufficiently. Also, the surface of the steel being cast shows more and more inclusions because the molten slagging composition cannot absorb impurities, primarily alumina, from the molten steel fast enough. The certain optimum casting run length differs for each individual caster and type of steel being cast. The amount of protection the molten steel receives from the air while on its way to and in going through the caster influences the amount of alumina created and later evolved during casting. In some casters the optimum casting run length can be as short as 45 minutes. This length is even shorter than the time required for a single heat of steel to be cast. In some casters, with much better protection, the optimum casting run length can be up to 8 or more hours, representing casting of several heats of steel without interruption.

The performance characteristics of the molten particulate slagging composition can deteriorate to such an extent that unacceptable surfaces on the steel being cast result. Also, with the evolution of more and more alumina into the slag, the viscosity of the molten composition can rise to such a high value that necessary lubrication of the mold is no longer provided. The rise in viscosity can hinder the liquid slagging composition's movement into the space between the mold wall and the forming solid steel shell. When the gap is unlubricated due to the absence of liquid slag, the steel shell can seize on the mold wall and the resulting danger of a breakout becomes unacceptable. Finally, the heat transfer value can lessen to such an extent that not a thick enough solid steel shell is created in the mold and the chances for a breakout through a smaller hole also become unacceptable. When any of these three things, or a combination of things, happens the caster must either be shut down immediately or the casting run interrupted. These shutdowns or interruptions happen in spite of the fact that the molten pool of particulate slagging composition covering the molten steel receives continuous additions of the unmelted particulate slagging composition. Thus, the problem of alumina absorption is more than just the problem of adding more mold powder, which of course is itself expensive. The alumina absorption problem, in fact, leads to shorter, inefficient, costly casting runs on the continuous caster.

Previous attempts to deal with this problem have focused on the so-called "V" ratio. The "V" ratio is generally defined as the lime to silica ratio. Koenig and Hofmanner in U.S. Pat. No. 3,788,840 require a lime-silica ratio in the flux powder to be in the range of 0.7–1.0. This arrangement is achieved by the addition of quartz powder. Koenig and Hofmanner in their '840 patent also require the aluminum oxide content of the powder to be in the range of 2–12% by weight. While helping to improve the performance characteristics of their flux powder on a continuous casting run, the flux powder cannot withstand the addition of great amounts of alumina experienced in an extended run and allow optimum casting to continue. An advantage of the instant particulate slagging composition is the greater ability to absorb more alumina, thus extending the length of the optimum continuous casting run possible.

BROAD STATEMENT OF THE INVENTION

One aspect of this invention is a particulate slagging composition for the continuous casting of steel, said steel tending to evolve alumina into said composition when said composition is in molten condition during its use in the continuous casting operation, said slagging composition being characterized by flowidity of about 4 to 16 inches, fusion range not substantially above 2300° F., a Start-up ADK value not exceeding 500 seconds, said composition further characterized by having the following theoretical net oxide analysis, wherein the percentages are weight percentages and are selected to total 100%:

| Fluxing Ingredients | Wt. % |
|---|---|
| CaO* | 0–42 |
| MgO* | 0–20 |
| BaO* | 0–20 |
| SrO* | 0–20 |
| MnO* | 0–20 |
| FeO* | 0–18 |
| F* (elemental component of the fluorine-providing materials) | 4–16 |
| $B_2O_3$* | 0–15 |
| $Na_2O$ | 1–25 |
| $K_2O$ | 0–5 |
| $Li_2O$ | 0–5 |
| $V_2O_5$ | 0–1 |
| NiO | 0–2 |
| CuO | 0–2 |
| ZnO | 0–1 |
| $TiO_2$ | 0–5 |
| $ZrO_2$ | 0–3 |
| CoO | 0–2 |
| $Cr_2O_3$ | 0–2 |
| $MoO_3$ | 0–1 |
| Glass Network Formers | |
| $SiO_2$ | 20–40 |
| $Al_2O_3$ | 0–12 |
| $P_2O_5$ | 0–10 |
| $B_2O_3$ | included above; |

the ratio of the sum of the theoretical net oxide analysis values of the starred (*) fluxing ingredients to the theoretical net oxide analysis value of $SiO_2$ (this ratio being termed the R′ ratio) being preselected between 1.5:1 and 3:1 for obtaining an Operational ADK value not substantially in excess of 750 seconds.

Another aspect of this invention is the improvement in the process for the continuous casting of steel wherein a pool of molten steel is maintained in the upper end of an open-ended continuous casting mold, the improvement which comprises establishing and maintaining on the top of said pool a protective layer of the particulate slagging composition of the theoretical net oxide analysis and R′ ratio listed above with a small proportion of elemental carbon.

DETAILED DESCRIPTION OF THE INVENTION

The vitrifaction or vitrified fraction of the instant flux is made conventionally in a smelter or the like. Molten glass from the smelter conventionally is fritted by pouring a stream of it into water or by fracturing it subsequent to its passage between chilled rolls. Often the resulting frit is milled (ground) to pass 150 mesh (Tyler Standard) or finer for use in continuous casting.

Such frit basically is made from glass network formers and fluxing agents therefor. Glass network formers include silica, boria, and alumina, with silica being the principal one. Phosphorus pentoxide also is a useful glass network former, but less desirable for steel fluxing, particularly with the particulate slagging compositions of this invention. Principal fluxing oxides are Group 1A and 2A metal oxides, typically, potassium oxide, sodium oxide, calcium oxide, magnesium oxide, strontium oxide, barium oxide, iron oxide (FeO), manganese oxide, and lithium oxide. Copper oxide, nickel oxide, phosphorus pentoxide and zinc oxide can also act as fluxing agents, but their use in particulate slagging compositions is unusual because these four oxides sometimes degrade the surface of the same types of metal being cast. In the proportions that they can be used in the present compositions, the other oxides of Period IV metals having atomic number of 22–30, inclusive, the oxides of titania, cobalt, manganese, chromium, vanadium as well as zirconium oxide and molybdenum oxide act as fluxes. Some people prefer to consider them as glass modifiers, particularly when they are used in a greater proportion. Vanadium, phosphorus and molybdenum oxides are not recommended for use since they may cause serious problems with the water added to end the casting run. Fluorine also acts to dissolve alumina and also to flux generally.

The vitrified part of the instant flux can be one or a plurality of frits. In the latter case the frits can be agglomerated, such as by sintering. However, mere mechanical mixing of the frits is adequate and preferred. The raw glass batch for the vitrified portion of the flux, namely the vitrifaction, usually is in the form of minerals and chemicals of purity satisfactory for glass making; this is a prudent criterion. The fluorine-providing material can be simple or complex fluoride salts, typically fluorspar, cryolite, alkali and alkaline earth metal fluorides, and alkali metal fluosilicates. For use with steel a preferred and most practical fluorine-providing raw material is fluorspar, either synthetic or natural.

An alternate method of practicing this invention is a mold powder made by intimately mechanical blending of the particulate raw batch components set forth above as frit ingredients. The particles of the components are not greater than about 100 mesh in size (Tyler Sieve Series). The blend may be heated to some extent, but not to the extent that the components start to fuse together and form a vitrifaction. However, when the mold powder is placed on the molten pool of steel in the caster, the mold powder should melt without residue and thereby avoid the presence of igneous byproducts which cause surface defects on the steel cast. The big advantage of a mold powder over a vitrifaction or flux is the lower cost due to the fact that smelting of the raw batch components is no longer required before use in casting.

Different properties of the instant particulate slagging compositions were measured by specific tests. Smelting temperatures were taken by means of an optical pyrometer. The smelting temperatures were taken at the end of 14 minutes. Flowidity was measured by the method set out in U.S. Pat. No. 3,649,249. Alumina dissolution kinetics (hereafter called ADK) and fusion ranges were measured by special tests, the procedures for which are explained later.

Different types of steel to be cast with the instant particulate slagging compositions worked better when the compositions have certain measured properties. Fusion range temperatures, as long as the upper limits were below the lowest temperatures of the steel to be cast with the particular compositions, did not affect the process of casting. A margin of safety of at least a couple of hundred degrees Fahrenheit is preferred. However, the type of killed steel is important in selecting the composition with the right values for alumina dissolution kinetics and flowidity. In the case of aluminum-killed steel the flowidity value must be over 4, but not over 16. The alumina dissolution kinetics (ADK) should initially be in the lower end of the values for the particulate slagging composition. The initial ADK value shall hereafter be referred to as *Start-up ADK* to represent the characteristics of a molten slagging composition at the start of a casting run, before any appreciable amount of alumina has evolved into the protective layer of slag. For austenitic stainless steels and silicon-killed steels, the flowidity values of the composition can be lower than 3, and its Start-up ADK ordinarily need not be as favorable; thus the value in seconds for its "alumina dissolution kinetics" in such instance can be a higher number, but not exceeding 500 seconds. After sufficient alumina has been absorbed from the steel being cast to bring the evolved alumina percentage to 10% of the molten composition, the ADK value should not exceed 750 seconds. This second ADK value shall hereafter be referred to as *Operational ADK*. Operational ADK value is defined to be that ADK value obtained, by the ADK test procedure later described, from a sample of 225 wt. parts of completely molten and vitrified slagging composition (exclusive of any carbon added) in which there has been dissolved 25 wt. parts of extra alumina ($Al_2O_3$). In the event that the slagging composition so tested emits volatile material such as carbon dioxide in the process of melting same, said 225 wt. parts is the non-volatile residue.

Accordingly, should some such volatile components be expected for such testing, the initial weight of unmelted slagging composition should be augmented to account for same. In this test it is customary to blend the particulate slagging composition for test with pulverulent extra $Al_2O_3$ prior to melting same.

The special test procedure used to determine the fusion ranges in the previous examples required weighing out 3.00 grams of the sample particulate slagging compositions. A weighed-out sample was put into a pellet mold that would produce a ½-inch (1.27 cm.) diameter pellet in cylindrical form. The mold was then put into a hydraulic press and subjected to a pressure of 5,000 pounds per square inch (350 kg./cm$^2$). The pellet formed from the sample material was placed in the center of a stainless steel plate, ½-inch (1.27 cm.) thick and 2 inches (5.08 cm.) by 2 inches (5.08 cm.) square. The plate with the pellet on it was then placed in a furnace capable of supporting the plate in a precisely level position (to avoid the melted composition from running off the plate). The furnace was also capable of maintaining preselected temperatures between 1500° F. (816° C.) and 2300° F. (1260° C.). The sample was left in the furnace for exactly 3½ minutes.

Upon removal, the pellet was examined for any evidence of softening, primarily rounding of the edges. If there were such signs, the furnace temperature was taken as the lower fusion range temperature. If there were no such signs, the furnace temperature was increased by 50° F. (17.8° C.) and a new pellet was heated at the new temperature for exactly 3½ minutes. After the lower fusion range temperature was determined, the furnace temperature continued to be increased by 50° F. (17.8° C.) intervals until the upper fusion range temperature was determined. The upper temperature was evidenced by the sample flowing out into a thin melt, i.e. a puddle that had lost all cylindrical form.

The special test procedure used to determine alumina dissolution kinetics required the preparation of a graphite crucible without any drain holes. The crucible was prepared by boring a 1½-inch (3.76 cm.) diameter by 5 inches (12.70 cm.) deep hole in a 3-inch (7.62 cm.) diameter by 6 inches (15.24 cm.) in length pure graphite electrode. Alumina tubing having an outer diameter of 3/32 inch (0.25 cm.) and an inner diameter of 1/32 inch (0.092 cm.) was cut into a ¾-inch (1.89 cm.) segment with an abrasive-coated cut-off wheel. To hold the alumina tubing segment, a 3/32-inch (0.48 cm.) diameter horizontal hole was drilled ¼ inch (0.64 cm.) from the bottom of a rod 0.31 inches (0.8 cm.) in diameter and 8.07 inches (20.5 cm.) in length made from electrode grade graphite.

A sample of 250 grams of the particulate slagging composition was placed in the crucible. The crucible was heated to a temperature of 2600° F. (1427° C.) by a 7.5 KW Lepel induction furnace. While the crucible was being heated, the graphite rod containing the alumina sample was suspended over the crucible. This ensured a proper warm-up period which reduced the possibility of the alumina tube fracturing upon submersion into the composition. However, the alumina was sufficiently far enough above the melting composition such that no premature alumina dissolution occurred.

When the crucible had reached the 2600° F. (1427° C.) temperature according to an optical pyrometer reading, the alumina sample was submerged. Within 30 seconds or less, the graphite rod was withdrawn to check if the alumina sample had fractured. Sharp irregular breaks usually near the sample tip would have indicated fracture and the necessity to start the procedure again from the beginning. If no fracturing was evident, the sample was resubmerged. At 15-second intervals, the rod was withdrawn to see if dissolution had occurred. Dissolution occurred when no alumina remained in the rod. The test was run three times for each sample so that an average value could be calculated as the reported test result.

Of the two test procedures above, the most important one for the purposes of the instant invention is the ADK test. The present invention is addressed to the control of the alumina absorption characteristics after the particulate slagging composition has been used in a continuous caster for an appreciable period of time. Because the melted pool of particulate slagging composition is constantly absorbing more and more alumina evolved from the steel being cast, the characteristics of conventional slagging compositions change. The most important change is primarily noticed as a change in the Start-up ADK value to the Operational ADK value. This change is usually an increase meaning that the used slag will no longer absorb as much alumina as fast as when the casting run started. Industry practice held that when the "V" ratio ($CaO/SiO_2$) of the particulate slagging composition exceeded approximately 1.2, the dissolubility of $Al_2O_3$ in the melted composition tended to decrease. However, we have found that when the numerator of the "V" ratio is expanded to include other divalent fluxing ions, an increase in this ratio correlates to an increased ability of the slag to absorb alumina throughout a long optimum continuous casting run. This new ratio with an expanded numerator we shall call the "R" ratio. Specifically, the numerator of our "R" ratio is the sum of the theoretical net oxide values of CaO, MgO, SrO, MnO, FeO. Other divalent fluxing ions such as Ni, Cu, Zn are not included in our "R" ratio because these divalent fluxing ions have deleterious effects on the surface of the steel being cast as well as affecting the steel alloy ratios if the ions are reduced to elemental metal. In addition, Zn would fume off and present health problems to the workers near the caster head. The sum of the numerator is by addition of the percentages of theoretical net oxide analysis values for the divalent ions in the particulate slagging composition. The denominator of the "R" ratio remains the theoretical net oxide analysis value of silica.

A more sophisticated ratio for predicting the effect of changing net oxide analysis percentages is the R′ ratio. The R′ ratio shall be defined as the numerator consisting of the sum of the theoretical net oxide analysis values of the following components of the particulate slagging composition: CaO, MgO, BaO, SrO, MnO, FeO, $B_2O_3$, F. The denominator of the R′ ratio will still remain the theoretical net oxide analysis value of silica.

Finally, the following formula has been empirically determined to predict the effect on the Start-up alumina dissolution kinetics value of some of the components used in making up the particulate slagging compositions. A negative coefficient alongside the value for the theoretical net oxide analysis value of the component in the raw ingredients would correspond to a lesser alumina dissolution kinetics value. This lesser value would represent a shorter alumina dissolution kinetics time which indicates a molten particulate slagging composition that could more readily absorb alumina from the steel being cast. The formula is:

$$ADK = 1.894 + (-76.16)(F) + (-15.58)(B_2O_3) + (-12.77)(CaO) + (12.34)(SiO_2) + (-2.562)(B_2O_3)(X_2O^*) + (2.3335)(B_2O_3)^2 + (-6.033)(F)(X_2O) + (4.073)(F)(B_2O_3) + (7.872)(F)$$

*$X_2O$ represents the sum of $Na_2O$ and $K_2O$ theoretical net oxide analysis percentage when the $K_2O$ to $Na_2O$ ratio is held at 1:8.

This formula should not be expected to give exact alumina dissolution kinetic values, but merely estimate the quantitative effect on alumina dissolution kinetics for a given quantitative change in one of the constituents in the formula.

The following examples show ways in which the invention has been practiced, which should not be construed as limiting the invention. In this application, unless otherwise expressly noted, all parts are parts by weight, all percentages are weight percentages, all temperatures are in degrees Fahrenheit, with Celsius temperatures in parentheses, and all particle sizes are according to the Tyler Standard Sieve Series.

Two series of tests were run in all of the examples. The first series was performed on the vitrifactions or mold powders after formulation. The values obtained would represent the properties of the molten particulate slagging compositions at the Start-up of a continuous casting run of steel. The second series of tests to determine an Operational ADK value for a sample prepared by adding to the particulate slagging composition extra alumina in the amount sufficient to make 10% of the increased weight of the added-to composition in molten condition be due to the addition of extra alumina. Because the increased weight is that of the added-to composition in molten condition, the tester must compensate for any weight loss due to volatilization of any particulate slagging composition components by using more of the composition. For instance, in preparing a 250-gram increased weight sample for the Operational ADK test, if 10% of the particulate slagging composition is lost due to volatilization upon melting, the tester would use not 225 grams, but 250 grams. To this 250-gram amount of particulate slagging composition would be added 25 grams of alumina to produce the 250 grams final weight of molten, added-to slag in the crucible. The alumina would have to be added as a cool raw ingredient to cool vitrifaction or powders, of course, in order to undergo the flowidity test. The values obtained after the addition of alumina, termed the Operational ADK values, would represent the properties of the molten particulate slagging compositions after an extended optimum continuous casting run of alumina-evolving steel.

EXAMPLES 1-5

This first group of 5 particulate slagging compositions were all mold powders. These examples were prepared by intimately mechanically blending of the particulate raw batch components, none of which were greater than about 100 mesh in size (Tyler Sieve Series). The blends were not heated. The mold powders had the following raw batch composition ingredients (shown by weight parts):

| EXAMPLE | 1 | 2 | 3 | 4 | 5 |
|---|---|---|---|---|---|
| $Na_2O_3$ | 134 | 12 | 234 | 0 | 16 |
| $CaCO_3$ | 712 | 420 | 0 | 0 | 309 |
| $CaF_2$ | 215 | 482 | 399 | 200 | 666 |
| $SiO_2$ | 263 | 0 | 255 | 0 | 0 |
| Kaolin | 229 | 0 | 0 | 0 | 0 |
| Dolomite | 0 | 0 | 0 | 0 | 493 |
| Spodumene | 0 | 0 | 482 | 0 | 0 |
| Nepheline Syenite | 6 | 563 | 0 | 0 | 779 |
| $Fe_3O_4$ | 0 | 60 | 91 | 188 | 83 |
| $MnO_4$ | 243 | 0 | 0 | 0 | 0 |
| $BaCO_3$ | 0 | 100 | 0 | 0 | 0 |
| MgO | 0 | 58 | 0 | 0 | 0 |
| Dehydrated Borax | 0 | 111 | 100 | 112 | 154 |
| $Li_2CO_3$ | 0 | 0 | 86 | 0 | 0 |
| NaF | 0 | 0 | 157 | 0 | 0 |
| Wollastonite | 0 | 0 | 0 | 1500 | 0 |

The mold powders had the following theoretical net oxide analysis (shown in percent by weight):

| EXAMPLE | 1 | 2 | 3 | 4 | 5 |
|---|---|---|---|---|---|
| $Na_2O$ | 5.6 | 5.9 | 16.2 | 1.7 | 6.0 |
| CaO | 37.9 | 33.8 | 16.2 | 41.6 | 35.1 |
| F | 7.2 | 13.5 | 14.8 | 4.8 | 14.0 |
| $SiO_2$ | 26.8 | 20.6 | 32.2 | 37.7 | 21.4 |
| $Al_2O_3$ | 7.8 | 11.3 | 7.2 | 0 | 8.2 |
| MgO | 0 | 0 | 0 | 0 | 5.0 |
| $K_2O$ | 0 | 1.6 | 0 | 0 | 1.6 |
| FeO | 0.9 | 3.8 | 5.5 | 9.9 | 3.8 |
| MnO | 13.1 | 0 | 0 | 0 | 0 |
| $B_2O_3$ | 0 | 4.5 | 3.9 | 3.8 | 4.7 |
| BaO | 0 | 4.7 | 0 | 0 | 0 |
| $Li_2O$ | 0 | 0 | 3.9 | 0 | 0 |

The mold powders had the following R ratio:

| EXAMPLE | 1 | 2 | 3 | 4 | 5 |
|---|---|---|---|---|---|
| | 2.0 | 2.1 | 0.7 | 1.4 | 2.1 |

Fusion ranges for the mold powders in °F. with the Celsius value (°C.) in parentheses were:

| EXAMPLE | 1 | 2 | 3 | 4 | 5 |
|---|---|---|---|---|---|
| | 2150°-2250° F. (1177°-1232° C.) | 1900-2000 (1038-1093) | 1700-2000 (927-1093) | 2100-2200 (1149-1204) | 1825-1900 (996-1038) |

The Herty flowidity values in inches before addition of extra alumina were:

| EXAMPLE | 1 | 2 | 3 | 4 | 5 |
|---|---|---|---|---|---|
| | 5.0 | 6.0 | 6.0 | 4.0 | 8.0 |

The Start-up alumina dissolution kinetics values in seconds before the addition of alumina were:

| EXAMPLE | 1 | 2 | 3 | 4 | 5 |
|---|---|---|---|---|---|
| | 205 | 200 | 310 | 390 | 195 |

After the addition of extra alumina sufficient to make up 10% of the final weight, the Herty flowidity values in inches were:

| EXAMPLE | 1 | 2 | 3 | 4 | 5 |
|---|---|---|---|---|---|
| | 5.25 | 4.75 | 1.75 | 2.25 | 5.25 |

and the Operational ADK values in seconds after addition were:

| EXAMPLE | 1 | 2 | 3 | 4 | 5 |
|---|---|---|---|---|---|
| | 195 | 335 | 2145 | 495 | 465 |

The differences before and after addition of alumina in the Herty flowidity values in inches were:

| EXAMPLE | 1 | 2 | 3 | 4 | 5 |
|---|---|---|---|---|---|
| | +0.25 | −1.25 | −4.25 | −1.75 | −2.75 |

and differences in ADK values in seconds were:

| EXAMPLE | 1 | 2 | 3 | 4 | 5 |
|---|---|---|---|---|---|
| | −10 | +125 | +1835 | +105 | +270 |

From these five examples it can be seen that a high R ratio leads to small changes in the Herty flowidity and ADK times even after the addition of extra alumina, while a low R ratio as in Example 3 leads to large changes.

EXAMPLES 6-11

The following six particulate slagging compositions were all mold powders prepared and tested the same way as in Examples 1-5. The raw batch compositions (by weight parts) were:

| EXAMPLE | 6 | 7 | 8 | 9 | 10 | 11 |
|---|---|---|---|---|---|---|
| $SiO_2$ | 455 | 194 | 194 | 194 | 194 | 194 |
| Dehydrated Borax | 165 | 165 | 165 | 165 | 165 | 165 |
| $Na_2CO_3$ | 311 | 311 | 311 | 311 | 311 | 311 |
| $CaF_2$ | 142 | 142 | 142 | 142 | 142 | 142 |
| $CaCo_3$ | 885 | 443 | 0 | 0 | 0 | 0 |
| $K_2CO_3$ | 43 | 43 | 43 | 43 | 43 | 43 |
| Wollastonite | 0 | 514 | 514 | 514 | 514 | 514 |
| $Fe_3O_4$ | 0 | 0 | 0 | 241 | 0 | 0 |
| $MnO_2$ | 0 | 0 | 0 | 0 | 241 | 0 |
| $BaCO_3$ | 0 | 0 | 0 | 0 | 0 | 313 |
| MgO | 0 | 0 | 241 | 0 | 0 | 0 |

The examples had the following theoretical net oxide analysis (shown in percent by weight):

| EXAMPLE | 6 | 7 | 8 | 9 | 10 | 11 |
|---|---|---|---|---|---|---|
| $Na_2O$ | 15.4 | 15.4 | 15.4 | 15.4 | 15.4 | 15.4 |
| CaO | 38.8 | 38.8 | 22.8 | 22.8 | 22.8 | 22.8 |
| $B_2O_3$ | 7.6 | 7.6 | 7.6 | 7.6 | 7.6 | 7.6 |
| $SiO_2$ | 30.8 | 30.8 | 30.8 | 30.8 | 30.8 | 30.8 |
| $K_2O$ | 1.9 | 1.9 | 1.9 | 1.9 | 1.9 | 1.9 |
| F | 4.6 | 4.6 | 4.6 | 4.6 | 4.6 | 4.6 |
| FeO | 0 | 0 | 0 | 16.0 | 0 | 0 |
| MnO | 0 | 0 | 0 | 0 | 16.0 | 0 |
| BaO | 0 | 0 | 0 | 0 | 0 | 16.0 |
| MgO | 0 | 0 | 16.0 | 0 | 0 | 0 |

The mold powders all had the R ratios of 1.25. Fusion ranges for the mold powders in °F. (°C.) were:

| EXAMPLE | 6 | 7 | 8 | 9 | 10 | 11 |
|---|---|---|---|---|---|---|
| | 1875°-2000° F. (1024°-1093° C.) | 1875-2000 (1024-1093) | 1700-1850 (927-1010) | 1650-1750 (899-954) | 1700-1800 (927-982) | 1700-1800 (927-982) |

The Herty flowidity value in inches before addition of extra alumina were:

| EXAMPLE | 6 | 7 | 8 | 9 | 10 | 11 |
|---|---|---|---|---|---|---|
| | 7.0 | 7.25 | 7.75 | 5.25* | 6.75 | 7.5 |

*Composition so reactive in carbon crucible that temperature of test was 2400° F. (1316° C.) since 2600° F. (1427° C.) could not be attained.

The Start-up alumina dissolution kinetics values in seconds before the addition of extra alumina were:

| EXAMPLE | 6 | 7 | 8 | 9 | 10 | 11 |
|---|---|---|---|---|---|---|
| | 192 | 305 | 405 | 240* | 250 | 390 |

*Composition so reactive in carbon crucible that temperature of test was 2400° F. (1316° C.) since 2600° F. (1427° C.) could not be attained.

After the addition of extra alumina sufficient to make up 10% of the final weight, the Herty flowidity values in inches were:

| EXAMPLE | 6 | 7 | 8 | 9 | 10 | 11 |
|---|---|---|---|---|---|---|
| | 4.0 | 4.75 | 4.50 | 3.0 | 3.75 | 3.75 |

and the Operational ADK values in seconds after addition were:

| EXAMPLE | 6 | 7 | 8 | 9 | 10 | 11 |
|---|---|---|---|---|---|---|
| | 255 | 425 | 593 | 345 | 330 | 540 |

The difference before and after addition of the Herty flowidity values in inches were:

| EXAMPLE | 6 | 7 | 8 | 9 | 10 | 11 |
|---|---|---|---|---|---|---|
| | 3.0 | 2.50 | 3.25 | 2.25 | 3.00 | 3.75 |

and differences in ADK values in seconds were:

| EXAMPLE | 6 | 7 | 8 | 9 | 10 | 11 |
|---|---|---|---|---|---|---|
| | +63 | −55 | +188 | −15 | +50 | −15 |

These six examples all show mold powders that would be satisfactory for use in an extended optimum continuous casting run of steel.

EXAMPLES 12–16

The following five examples were all vitrifactions that were formulated to yield the same theoretical net oxide analysis as the preceding examples, except for Example 7. Corresponding to the order of presentation, Example 12 has the same analysis as does Example 6 and so on, (i.e. 13 corresponds to 8, 14 to 9, 15 to 10, and 16 to 11). The vitrifactions were prepared by conventionally dry-mixing, fusing, and water quenching of the following raw batch ingredients listed by weight parts:

| EXAMPLE | 12 | 13 | 14 | 15 | 16 |
|---|---|---|---|---|---|
| $SiO_2$ | 796 | 870 | 870 | 870 | 836 |
| Dehydrated Borax | 289 | 323 | 323 | 323 | 310 |
| $Na_2CO_3$ | 544 | 608 | 608 | 608 | 585 |
| $CaF_2$ | 248 | 278 | 278 | 278 | 267 |
| $CaCO_3$ | 1548 | 866 | 866 | 866 | 833 |
| $K_2CO_3$ | 72 | 84 | 84 | 84 | 81 |
| $Fe_3O_4$ | 0 | 0 | 471 | 0 | 0 |
| $MnO_2$ | 0 | 0 | 0 | 471 | 0 |
| $BaCO_3$ | 0 | 0 | 0 | 0 | 588 |
| MgO | 0 | 471 | 0 | 0 | 0 |

The fluorine actually remaining in the frit was 3.4% by weight percent. The R ratios for all the examples will correspond to the previous examples the same way as do the theoretical net oxide analysis values.

Fusion ranges for the vitrifactions in °F., with the Celsius value (°C.) in parentheses, were:

| EXAMPLE | 12 | 13 | 14 | 15 | 16 |
|---|---|---|---|---|---|
| | 1925°–2050° F. (1052°–1121° C.) | 1725–1950 (941–1066) | 1675–1800 (912–982) | 1725–1800 (941–982) | 1700–1875 (927–1024) |

The Herty flowidity values in inches before addition of extra alumina were:

| EXAMPLE | 12 | 13 | 14 | 15 | 16 |
|---|---|---|---|---|---|
| | 6.75 | 5.5 | 2.25* | 5.75 | 5.50 |

*Composition so reactive in carbon crucible that temperature of test, if any, was 2400° F. (1316° C.) since 2600° F. (1427° C.) could not be attained.

The Start-up alumina dissolution kinetics value in seconds before the addition of alumina were:

| EXAMPLE | 12 | 13 | 14 | 15 | 16 |
|---|---|---|---|---|---|
| | 450 | 570 | * | 303 | 307 |

*Composition so reactive in carbon crucible that temperature of test, if any, was 2400° F. (1316° C.) since 2600° F. (1427° C.) could not be attained.

After the addition of extra alumina sufficient to make up 10% of the final weight, the Herty flowidity values in inches were:

| EXAMPLE | 12 | 13 | 14 | 15 | 16 |
|---|---|---|---|---|---|
| | 3.125 | 3.75 | 2.75* | 3.50 | 3.25 |

*Composition so reactive in carbon crucible that temperature of test, if any, was 2400° F. (1316° C.) since 2600° F. (1427° C.) could not be attained.

and the Operational ADK values in seconds after addition were:

| EXAMPLE | 12 | 13 | 14 | 15 | 16 |
|---|---|---|---|---|---|
| | 540 | 670 | * | 435 | 390 |

*Composition so reactive in carbon crucible that temperature of test, if any, was 2400° F. (1316° C.) since 2600° F. (1427° C.) could not be attained.

The differences before and after addition of Herty flowidity were:

| EXAMPLE | 12 | 13 | 14 | 15 | 16 |
|---|---|---|---|---|---|
| | +3.625 | −1.75 | +.50 | −2.25 | −2.25 |

and differences in ADK values were:

| EXAMPLE | 12 | 13 | 14 | 15 | 16 |
|---|---|---|---|---|---|
| | +90 | +100 | * | +132 | +83 |

*Composition so reactive in carbon crucible that temperature of test, if any, was 2400° F. (1316° C.) since 2600° F. (1427° C.) could not be attained.

From these five examples, it can be seen that a high R ratio leads to small changes in the Herty flowidity and ADK times even after the addition of 10% alumina.

We claim:

1. Particulate slagging composition for the continuous casting of steel, said steel tending to evolve alumina into said composition when said composition is in molten condition during its use in the continuous casting operation, said slagging composition being characterized by flowidity of about 4 to 16 inches, fusion range not substantially above 2300° F., a Start-up ADK value not exceeding 500 seconds, said composition further characterized by having theoretical net oxide analysis values within the following ranges wherein the percentages are weight percentages and are selected to total 100%:

| Fluxing Ingredients | Wt. % |
|---|---|

-continued

| | |
|---|---|
| CaO* | 0–42 |
| MgO* | 0–20 |
| BaO* | 0–20 |
| SrO* | 0–20 |
| MnO* | 0–20 |
| FeO* | 0–18 |
| F* (elemental component of the fluorine-providing materials) | 4–16 |
| $B_2O_3$* | 0–15 |
| $Na_2O$ | 1–25 |
| $K_2O$ | 0–5 |
| $Li_2O$ | 0–5 |
| $V_2O_5$ | 0–1 |
| NiO | 0–2 |
| CuO | 0–2 |
| ZnO | 0–1 |
| $TiO_2$ | 0–5 |
| $ZrO_2$ | 0–3 |
| CoO | 0–2 |
| $Cr_2O_3$ | 0–2 |
| $MoO_3$ | 0–1 |
| Glass Network Formers | |
| $SiO_2$ | 20–40 |
| $Al_2O_3$ | 0–12 |
| $P_2O_5$ | 0–10 |
| $B_2O_3$ | included above; |

the ratio of the sum of the theoretical net oxide analysis values of the starred (*) fluxing ingredients to the theoretical net oxide analysis value of $SiO_2$ (this ratio being termed the R′ ratio) being preselected between 1.5:1 and 3:1 for obtaining an Operational ADK value not substantially in excess of 750 seconds.

2. the particulate slagging composition of claim 1 wherein said ratio (R′) is approximated by substituting therefor the ratio of the sum of the theoretical net oxide analysis values of the alkaline earth metal oxides plus FeO and MnO to the theoretical net oxide analysis value of silica (this ratio being termed the "R" ratio), said R ratio being between 0.8:1 and 2.5:1.

3. The composition of claim 1 wherein the theoretical net oxide analysis values are used to solve the equation below, the ratio of $K_2O$ to $Na_2O$ oxide analysis values is 1:8, the sum of $Na_2O$ and $K_2O$ oxide analysis values is represented in the equation as $X_2O$, the solution of said equation substantially predicts the Start-up ADK value of said composition, and the F, $B_2O_3$, Cao, $X_2O$, and $SiO_2$ oxide analysis values are selected to minimize said start-up ADK value in accordance with said equation, said equation being:

$$ADK = 1.894 + (-76.16)(F) + (-15.58)(B_2O_3) + (-12.77)(CaO) + (12.34)(SiO_2) + (-2.562)(B_2O_3)(X_2O) + (2.3335)(B_2O_3)^2 + (-6.033)(F)(X_2O) + (4.073)(F)(B_2O_3) + (7.872)(F)^2.$$

4. The particulate slagging composition of claim 1 which is a vitrifaction.

5. The particulate slagging composition of claim 1 which is partially vitreous.

6. The composition of claim 5 which contains fluorine, there being not more than about 5% fluorine in the vitreous portion of said composition and the remainder being in the form of unvitrified particles of fluorine-providing material.

7. The particulate slagging composition of claim 1 which has been intimately blended to form a mold powder, but has not been vitrified.

8. The particulate slagging composition of claim 1 wherein there is admixed about 1–10% of finely divided carbon particles.

9. The particulate slagging composition of claim 1 wherein after said addition of extra alumina has been dissolved into said composition, the flowidity value increases and the Operational ADK value is less than the Start-up ADK value.

10. The particulate slagging composition of claim 1 containing no alumina.

11. In a process for the continuous casting of steel wherein a pool of molten steel is maintained in the upper end of an open-ended continuous casting mold, the improvement which comprises establishing and maintaining on the top of said pool a protective layer of the particulate slagging composition of claim 1.

12. In a process for the continuous casting of a steel wherein a pool of molten steel is maintained in the upper end of an open-ended continuous casting mold, the improvement which comprises establishing and maintaining on the top of said pool a protective layer of the composition of claim 8.

13. The particulate slagging composition of claim 1 which has the following theoretical net oxide analysis values in weight percent: 6.0 $Na_2O$, 35.1 CaO, 14.0 F (elemental component of the fluorine-providing materials), 21.4 $SiO_2$, 8.2 $Al_2O_3$, 5.0 MgO, 1.6 $K_2O$, 3.8 FeO, 4.7 $B_2O_3$.

14. The particulate slagging composition of claim 1 which has the following theoretical net oxide analysis values in weight percent: 1.7 $Na_2O$, 41.6 CaO, 4.8 F (elemental component of the fluorine-providing materials), 37.7 $SiO_2$, 9.9 FeO, 3.8 $B_2O_3$.

* * * * *